US010428531B2

(12) United States Patent
Pindrik

(10) Patent No.: US 10,428,531 B2
(45) Date of Patent: Oct. 1, 2019

(54) FOLDABLE STAIRCASE

(71) Applicant: Michael Pindrik, Baltimore, MD (US)

(72) Inventor: Michael Pindrik, Baltimore, MD (US)

( * ) Notice: Subject to any disclaimer, the term of this patent is extended or adjusted under 35 U.S.C. 154(b) by 0 days.

(21) Appl. No.: 16/140,518

(22) Filed: Sep. 24, 2018

(65) Prior Publication Data

US 2019/0093368 A1 Mar. 28, 2019

Related U.S. Application Data

(60) Provisional application No. 62/562,039, filed on Sep. 22, 2017.

(51) Int. Cl.

| | |
|---|---|
| ***E04F 11/06*** | (2006.01) |
| ***E04B 1/343*** | (2006.01) |
| ***E04B 1/344*** | (2006.01) |
| ***E06C 1/00*** | (2006.01) |
| ***E06C 1/38*** | (2006.01) |

(52) U.S. Cl.

CPC ..... *E04F 11/062* (2013.01); *E04B 1/3448* (2013.01); *E04B 1/34336* (2013.01); *E06C 1/005* (2013.01); *E06C 1/38* (2013.01)

(58) Field of Classification Search

CPC ..... E04F 11/062; A47C 12/02; E04B 1/3448; E04B 1/34336; E06C 1/38; E06C 1/005

See application file for complete search history.

(56) References Cited

U.S. PATENT DOCUMENTS

| | | | | |
|---|---|---|---|---|
| 3,842,935 | A * | 10/1974 | Frank | E04D 13/035 182/81 |
| 9,856,654 | B1 * | 1/2018 | Tagart | E04F 11/062 |
| 9,957,720 | B1 * | 5/2018 | Brunner | E06C 1/34 |
| 2009/0211845 | A1 * | 8/2009 | Hoffman | E06C 1/16 182/165 |
| 2009/0288351 | A1 * | 11/2009 | Burke | E04F 11/064 52/183 |
| 2013/0256057 | A1 * | 10/2013 | Kasinski | E04F 11/06 182/81 |
| 2015/0047273 | A1 * | 2/2015 | Whitten | E04F 11/062 52/183 |
| 2018/0371761 | A1 * | 12/2018 | Green | E04F 11/00 |

* cited by examiner

*Primary Examiner* — Rodney Mintz

(57) ABSTRACT

A foldable staircase that can be easily transported and conveniently used rather than a ladder. The foldable staircase includes a lower staircase and an upper staircase. The upper staircase and the lower staircase are constructions that bridge vertical distances and provide platforms allowing the user to walk up or down the foldable staircase. The foldable staircase provides an alternative means to reach high areas that is easy and safe to ascend or descend as conventional stairways and staircases along with the transportability of a conventional ladder. The foldable staircase can be adjusted to a collapsed configuration or operative configuration. The collapsed configuration allows a user to store or easily transport the foldable staircase. The operative configuration allows the user to ascend or descend the foldable staircase.

17 Claims, 6 Drawing Sheets

FOLDABLE STAIRCASE

The current application claims a priority to the U.S. Provisional Patent application Ser. No. 62/562,039 filed on Sep. 22, 2017. The current application is filed on Sep. 24, 2018 while Sep. 22, 2018 was on a weekend.

FIELD OF THE INVENTION

The present invention relates generally to constructions that bridge vertical distances. More specifically, the present invention is a foldable staircase that can be easily transported and conveniently used rather than a ladder.

BACKGROUND OF THE INVENTION

Constructions that bridge vertical distances allow people to reach high areas. Examples of constructions that bridge vertical distances are staircases, ladders, and stairways. Constructions such as staircases and stairways are typically permanent to a certain location and can only be used at that specific location. On the other hand, ladders can be transported and moved to different locations to allow a person to reach high areas wherever the user desires. Ladders do have flaws such as being less safe and easy to ascend or descend when compared to staircases or stairways. Additionally, a ladder can be difficult to carry due to the weight of the ladder. There exists a need for a safer, easier means to reach high areas that can be easily transported.

It is therefore an objective of the present invention to provide a foldable staircase. The present invention provides a transportable construction that can bridge a vertical distance. The foldable staircase provides an easy and safe means to reach high areas as conventional stairways and staircases along with the easy transportability of a conventional ladder. The present invention consists of two main parts which are hingedly connected to each other. The present invention can be adjusted to a storage configuration in order to easily transport or store the invention. Moreover, the present invention includes a gripping element in order to easily transport the invention by pulling the present invention by the gripping element. The present invention can be adjusted to an operative configuration which allows a user to walk up or down the present invention.

DETAIL DESCRIPTIONS OF THE INVENTION

All illustrations of the drawings are for the purpose of describing selected versions of the present invention and are not intended to limit the scope of the present invention.

In reference to FIGS. 1 through 5, the present invention is a foldable staircase that can be easily transported and conveniently used rather than a ladder. The present invention comprises a lower staircase 1 and an upper staircase 2. The upper staircase 2 and the lower staircase 1 are constructions that bridge vertical distances and provide platforms allowing the user to walk up or down the present invention. The present invention provides an alternative means to reach high areas that is easy and safe to ascend or descend as conventional stairways and staircases along with the transportability of a conventional ladder.

Figure 1:
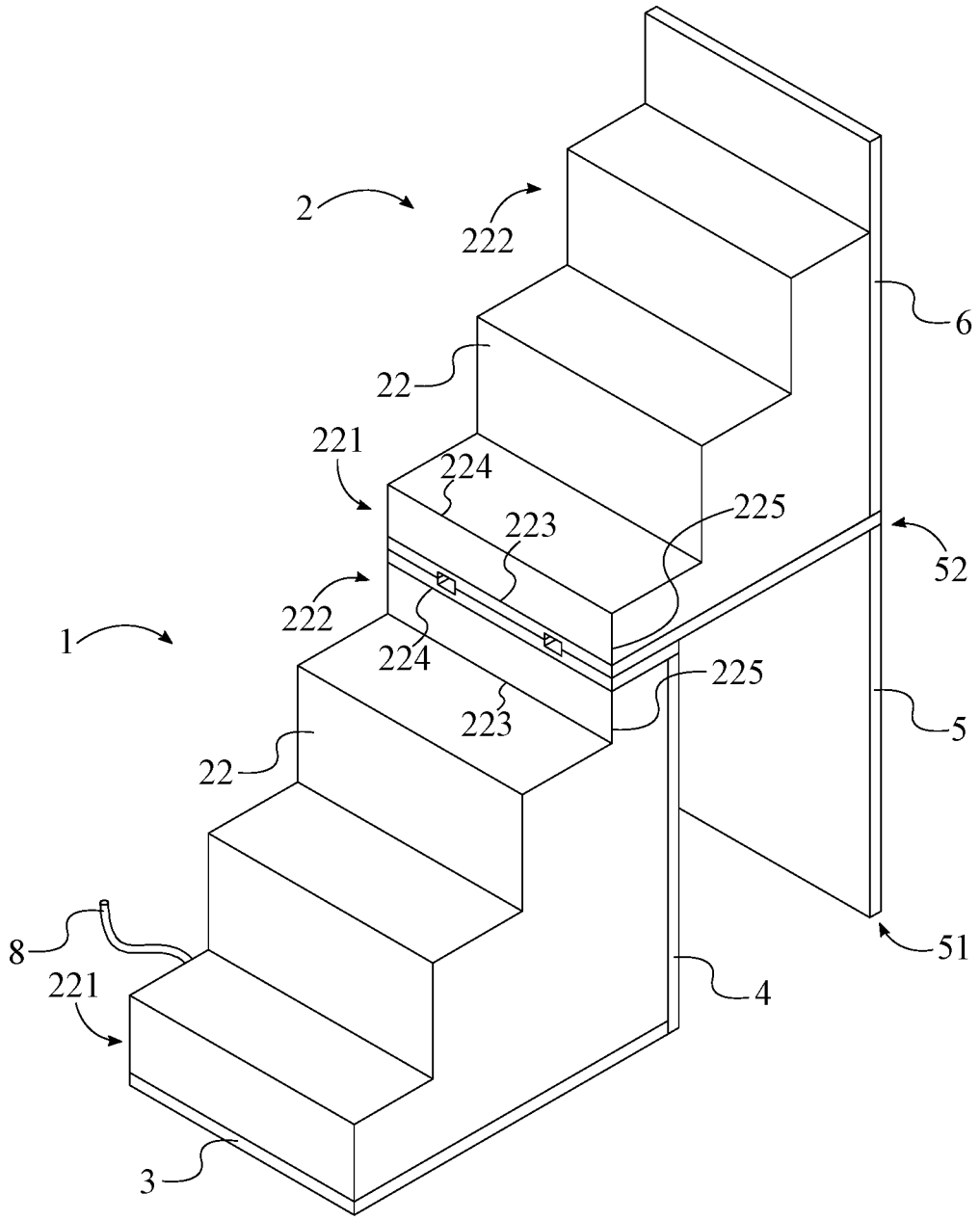
FIG. 1 is a front perspective of the present invention in its operative configuration.

The general configuration of the aforementioned components allows the present invention to be foldable and easily transportable. With reference to FIG. 1, the lower staircase 1 and the upper staircase 2 each comprise a series of steps 22. The series of steps 22 are horizontal platforms that allow a user to ascend or descend each the lower staircase 1 and the upper staircase 2. The series of steps 22 comprise a first step 221 and a last step 222. The first step 221 is the lowest, with respect to the ground, horizontal platform of the series of steps 22, and the last step 222 is the highest, with respect to the ground, horizontal platform of the series of steps 22. Consequently, the first step 221 and the last step 222 are positioned opposite to each other along the series of steps 22. In order to define the overall structure of each step, the series of steps 22 each comprise a first lengthwise edge 223, a second lengthwise edge 224, and a riser 225. The first lengthwise edge 223 and the second lengthwise edge 224 are positioned opposite to each other across the riser 225. In order for the present invention to be foldable, the second lengthwise edge 224 of the last step 222 for lower staircase 1 is hingedly connected to the first lengthwise edge 223 of the first step 221 for the upper staircase 2. In further detail, the upper staircase 2 can be rotated to interlock with the lower staircase 1 for the present invention to be in its storage configuration. In its operative configuration, the upper staircase 2 can be rotated where the series of steps 22 of the upper staircase 2 is sequential with the series of steps 22 of the lower staircase 1.

A reverse hinge is a type of hinge where two structures, that are hingedly connected, are not on the same plane. In order for the present invention to be properly folded for into its storage configuration and extended to its operative configuration and seen in FIGS. 1 and 4, the hinged connection between the second lengthwise edge 224 of the last step 222 for the lower staircase 1 and the first lengthwise edge 223 of the first step 221 for the upper staircase 2 is a reverse hinge mechanism. Furthermore, in order for the upper staircase 2 to be rotated to interlock with the lower staircase 1, the series of steps 22 for the lower staircase 1 must comprise one more step than the series of steps 22 for the upper staircase 2 so that, when the upper staircase 2 and the lower staircase 1 are interlocked with each other in the storage configuration, the present invention is shaped into an space-efficient box shape.

In order to define the structural shape of the present invention and as seen in FIG. 3, the lower staircase 1 and the upper staircase 2 each further comprise a right-triangular prismatic body 21. The right-triangular prismatic body 21 defines a common structural shape for constructions that bridge vertical distances. Moreover, the right-triangular prismatic body 21 comprises a first leg-related surface 211, a second leg-related surface 212, and a hypotenuse-related surface 213. The first leg-related surface 211, the second leg-related surface 212, and the hypotenuse-related surface 213 are used to identify reference points of a right-triangular prism. The series of steps 22 is integrated across the hypotenuse-related surface 213. This arrangement properly positions the series of steps 22 for both the upper staircase 2 and the lower staircase 1. The first leg-related surface 211 is positioned coincident to the first step 221, and the second leg-related surface 212 is positioned coincident to the last step 222. This arrangement further defines reference points for positioning of additional components of the present invention.

Figure 4:
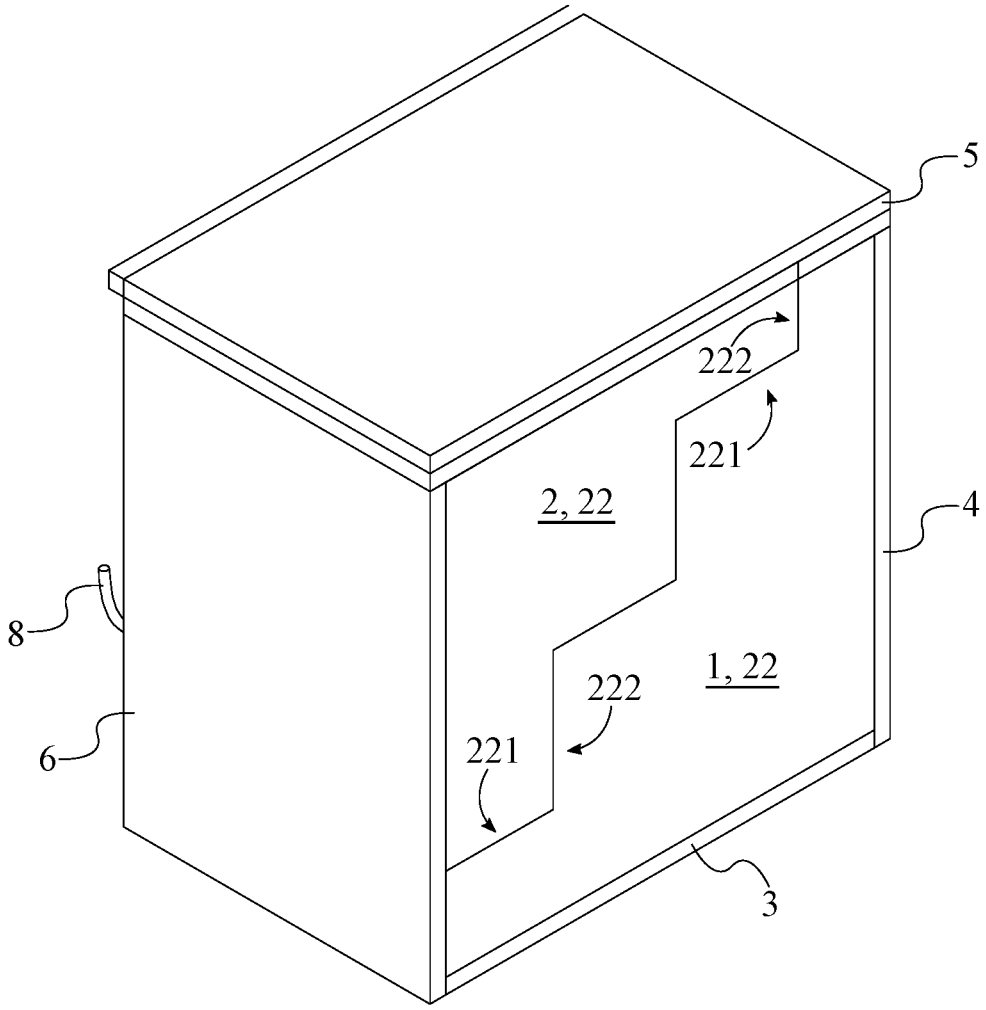
FIG. 4 is a front perspective of the present invention in its storage configuration.

As seen in FIGS. 1 and 4, the present invention may further comprise a first enclosure board 3 and a second enclosure board 4. The first enclosure board 3 and the second enclosure board 4 are used to border the lower staircase 1. The first enclosure board 3 is connected across the first leg-related surface 211 of the lower staircase 1. This arrangement properly positions the first enclosure to border the first leg-related surface 211 of the lower staircase 1. Similarly, the second enclosure board 4 is connected across the second leg-related surface 212 of the lower staircase 1. This arrangement properly positions the second enclosure board 4 to border the second leg-related surface 212 of the lower staircase 1.

With reference to FIGS. 1 and 4, the present invention may further comprise a swingable support board 5, a third enclosure board 6, and a counterfort 7. The swingable support board 5 is used to border a part of the upper staircase 2 and to vertically support the upper staircase 2 when rotated to the operative configuration. The third enclosure board 6 is used to border a part of the upper staircase 2. The counterfort 7 is used to maintain the swingable support board 5 in a vertical state when the present invention is in the operative configuration. The swingable support board 5 comprises a free edge 51 and a fixed edge 52. The free edge 51 and the fixed edge 52 are positioned opposite to each other across the swingable support board 5. The fixed edge 52 of the swingable support board 5 is hingedly connected to a perpendicular intersection of the first leg-related surface 211 of the upper staircase 2 and the second leg-related surface 212 of the upper staircase 2. This arrangement allows the swingable support board 5 to rotate about the perpendicular intersection of the upper staircase 2. Moreover, this arrangement allows the swingable support board 5 to be rotated in position as a border for the first leg-related surface 211 or to be positioned as a vertical support for the upper staircase 2. The third enclosure board 6 is connected across the second leg-related surface 212 of the upper staircase 2. This arrangement properly positions the third enclosure board 6 to border the second leg-related surface 212. The counterfort 7 is connected in between the free edge 51 of the swingable support board 5 and the lower staircase 1. This arrangement prevents the swingable support board 5 from displacing when acting as a vertical support to the upper staircase 2. Furthermore, the hinged connection between the fixed edge 52 of swingable support board 5 and the perpendicular intersection is a reverse hinge mechanism. This arrangement allows the swingable support board 5 to be properly rotated about the perpendicular intersection in order to border the first leg-related surface 211 and to act as a vertical support to the upper staircase 2.

Figure 5:
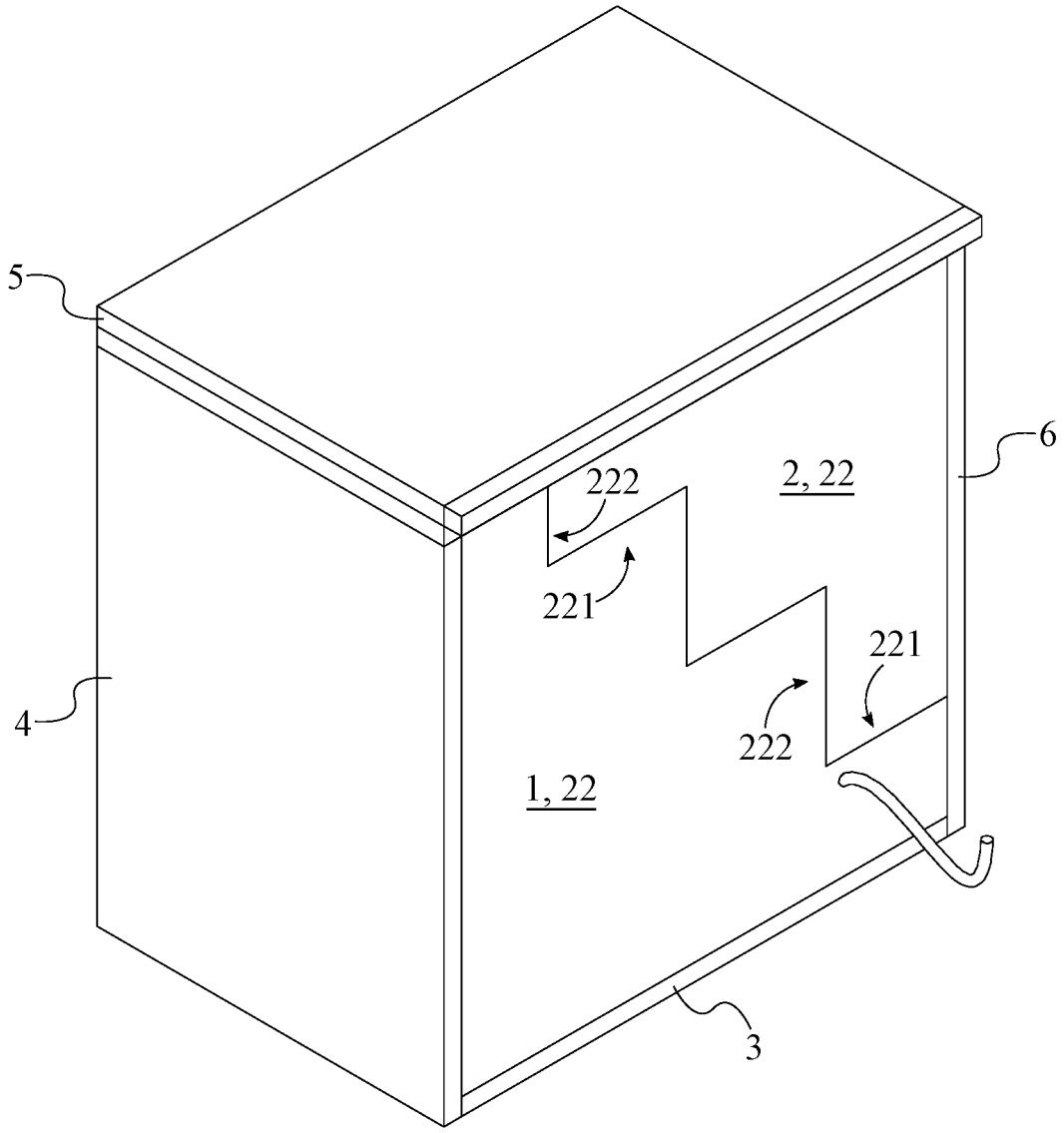
FIG. 5 is a rear perspective of the present invention in its storage configuration.

With reference to FIGS. 4 and 5, the present invention can be adjusted so that the lower staircase 1 and the upper staircase 2 are in a storage configuration. In the storage configuration, the series of steps 22 for the lower staircase 1 and the series of steps 22 for the upper staircase 2 are interlocked against each other. More specifically, the first step 221 of the lower staircase 1 is positioned adjacent to the last step 222 of the upper staircase 2. This arrangement allows the present invention to be collapsed for storage or for easily transporting the present invention.

Figure 3A:
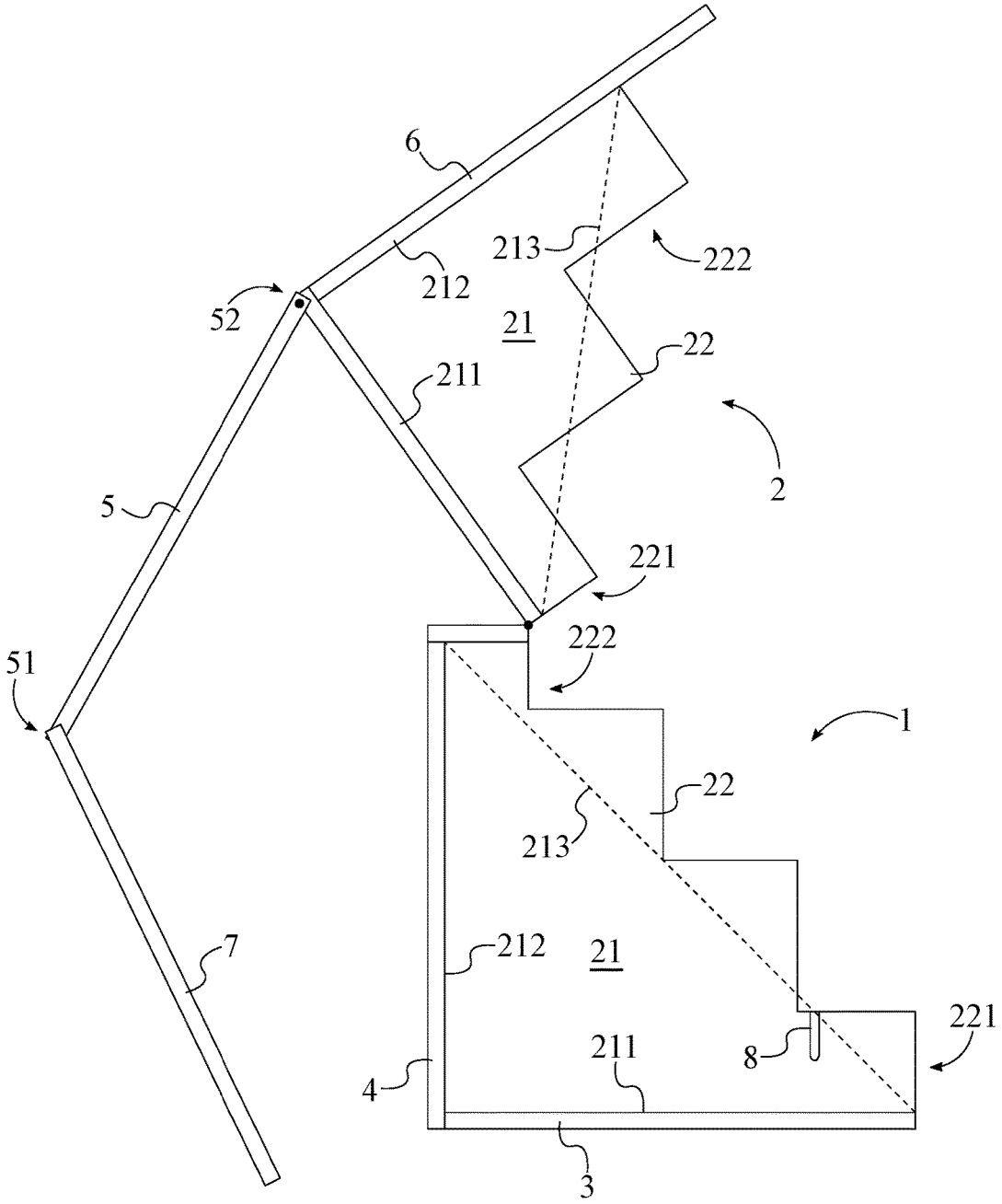
FIG. 3A is a left-side view of the present invention being rotated into its operative configuration.
Figure 3B:
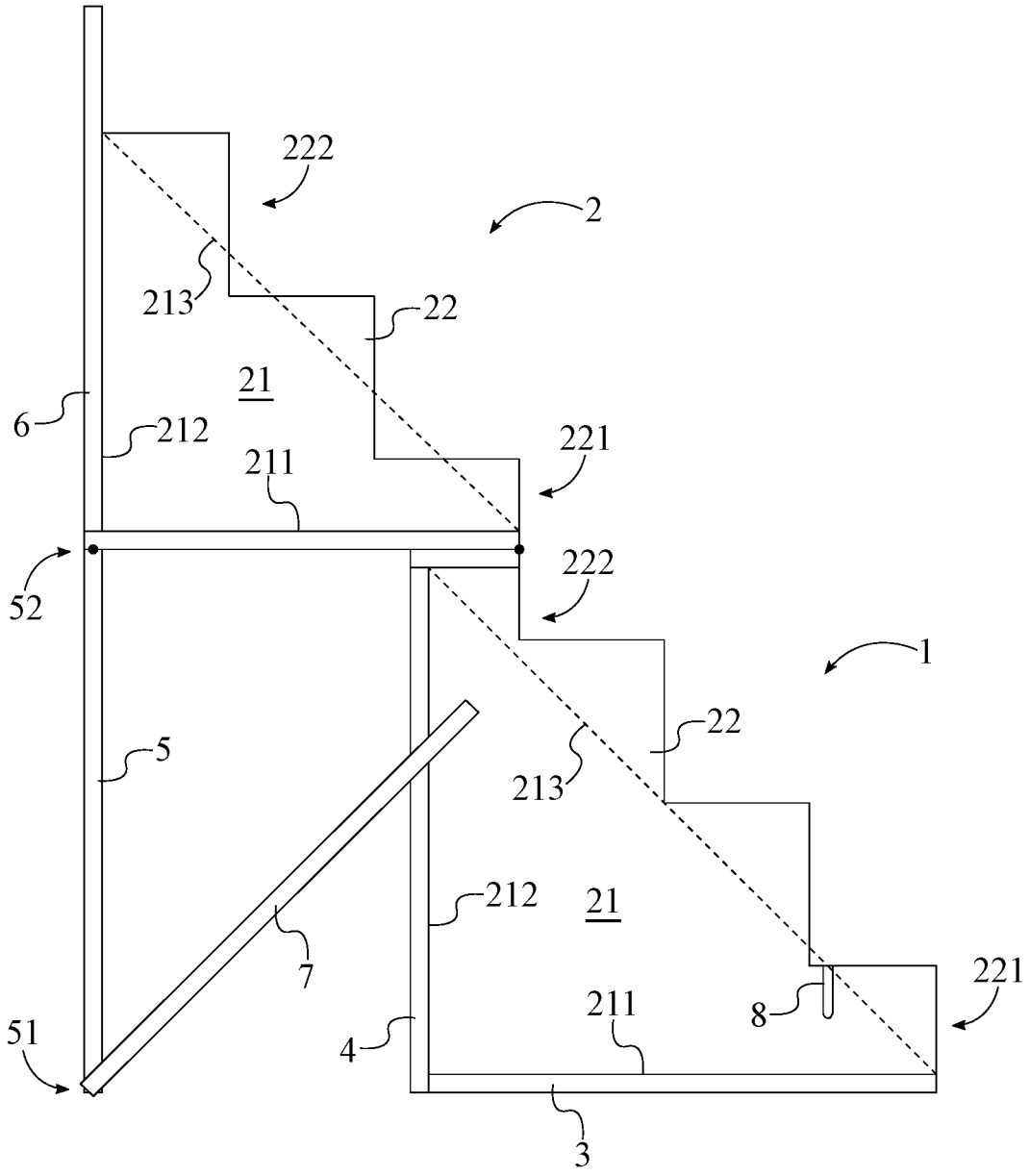
FIG. 3B is a left-side view of the present invention in its operative configuration.

With reference to FIGS. 3A and 3B, the present invention can be adjusted so that the lower staircase 1 and the upper staircase 2 are in an operative configuration. In the operative configuration, the series of steps 22 for the lower staircase 1 and the series of steps 22 for the upper staircase 2 are serially positioned to each other. More specifically, the first step 221 of the lower staircase 1 is positioned offset to the last step 222 of the upper staircase 2. This arrangement allows a user to walk up or down the lower staircase 1 and the upper staircase 2.

Figure 2:
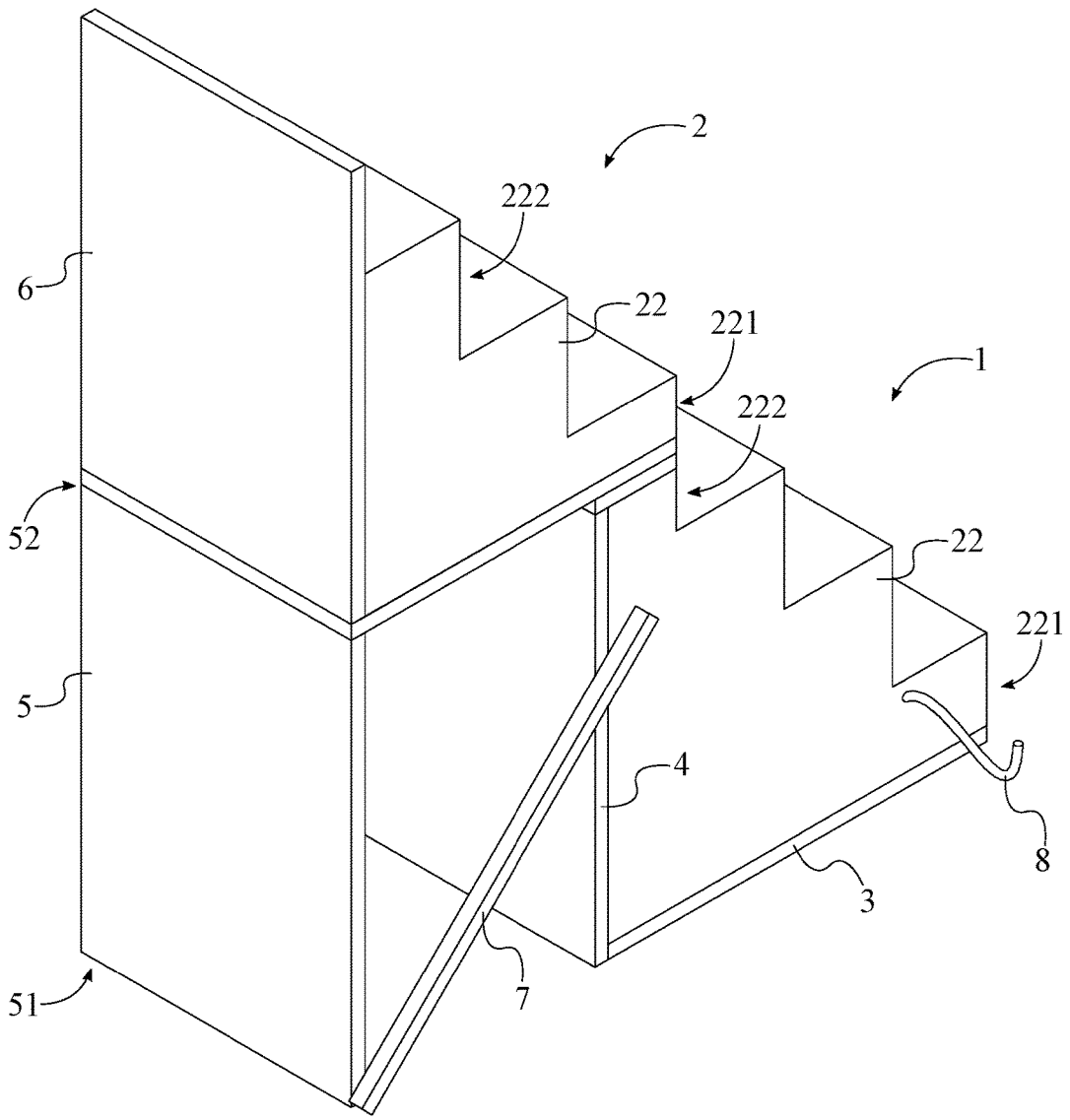
FIG. 2 is a rear perspective of the present invention in its operative configuration.

With reference to FIGS. 2 and 5, the present invention may further comprise a pulling tether 8. The pulling tether 8 acts a gripping element that allows a user to pull the present invention across a surface. The pulling tether 8 is terminally connected to the lower staircase 1, adjacent to the series of steps 22 of the lower staircase 1. This arrangement allows the user to easily access the pulling tether 8.

Although the invention has been explained in relation to its preferred embodiment, it is to be understood that many other possible modifications and variations can be made without departing from the spirit and scope of the invention as hereinafter claimed.

What is claimed is:

1. A foldable staircase comprises:
a lower staircase;
an upper staircase;
the lower staircase and the upper staircase each comprise a series of steps;
the series of steps comprises a first step and a last step;
the series of steps each comprise a first lengthwise edge, a second lengthwise edge, and a riser;
the first step and the last step being positioned opposite to each other along the series of steps;
the first lengthwise edge and the second lengthwise edge being positioned opposite to each other across the riser;
the second lengthwise edge of the last step for the lower staircase being hingedly connected to the first lengthwise edge of the first step for the upper staircase;
the lower staircase and the upper staircase each further comprise a right-triangular prismatic body;
the right-triangular prismatic body comprises a first leg-related surface, a second leg-related surface, and a hypotenuse-related surface;
the series of steps being integrated across the hypotenuse-related surface;
the first leg-related surface being positioned coincident to the first step; and
the second leg-related surface being positioned coincident to the last step.

2. The foldable staircase as claimed in claim 1, wherein the hinged connection between the second lengthwise edge of the last step for the lower staircase and the first lengthwise edge of the first step for the upper staircase being a reverse hinge mechanism.

3. The foldable staircase as claimed in claim 1, wherein the series of steps for the lower staircase comprises one more step than the series of steps for the upper staircase.

4. The foldable staircase as claimed in claim 1 comprises:
a first enclosure board;
a second enclosure board;
the first enclosure board being connected across the first leg-related surface of the lower staircase; and
the second enclosure board being connected across the second leg-related surface of the lower staircase.

5. The foldable staircase as claimed in claim 1 comprises:
wherein the lower staircase and the upper staircase being in a storage configuration;

the series of steps for the lower staircase and the series of steps for the upper staircase being interlocked against each other; and the first step of the lower staircase being positioned adjacent to the last step of the upper staircase.

6. The foldable staircase as claimed in claim 1 comprises:

wherein the lower staircase and the upper staircase being in an operative configuration;

the series of steps for the lower staircase and the series of steps for the upper staircase being serially positioned to each other; and the first step of the lower staircase being positioned offset to the last step of the upper staircase.

7. The foldable staircase as claimed in claim 1 comprises:

a pulling tether; and the pulling tether being terminally connected to the lower staircase, adjacent to the series of steps of the lower staircase.

8. The foldable staircase as claimed in claim 1 comprises:

a swingable support board;

a third enclosure board;

a counterfort;

the swingable support board comprises a free edge and a fixed edge;

the free edge and the fixed edge being positioned opposite to each other across the swingable support board;

the fixed edge of the swingable support board being hingedly connected to a perpendicular intersection of the first leg-related surface of the upper staircase and the second leg-related surface of the upper staircase;

the third enclosure board being connected across the second leg-related surface of the upper staircase; and the counterfort being connected in between the free edge and the lower staircase.

9. The foldable staircase as claimed in claim 8 comprises:

the hinged connection between the fixed edge of the swingable support board and the perpendicular intersection being a reverse hinge mechanism.

10. A foldable staircase comprises:

a lower staircase;

an upper staircase;

the lower staircase and the upper staircase each further comprise a right-triangular prismatic body;

the lower staircase and the upper staircase each comprise a series of steps;

the right-triangular prismatic body comprises a first leg-related surface, a second leg-related surface, and a hypotenuse-related surface;

the series of steps comprises a first step and a last step;

the series of steps each comprise a first lengthwise edge, a second lengthwise edge, and a riser;

the first step and the last step being positioned opposite to each other along the series of steps;

the first lengthwise edge and the second lengthwise edge being positioned opposite across the riser;

the second lengthwise edge of the last step for the lower staircase being hingedly connected to the first lengthwise edge of the first step for the upper staircase;

the series of steps being integrated across the hypotenuse-related surface;

the first leg-related surface being positioned coincident to the first step; and the second leg-related surface being positioned coincident to the last step.

11. The foldable staircase as claimed in claim 10, wherein the hinged connection between the second lengthwise edge of the last step for the lower staircase and the first lengthwise edge of the first step for the upper staircase being a reverse hinge mechanism.

12. The foldable staircase as claimed in claim 10, wherein the series of steps for the lower staircase comprises one more step than the series of steps for the upper staircase.

13. The foldable staircase as claimed in claim 10 comprises:

a first enclosure board;

a second enclosure board;

the first enclosure board being connected across the first leg-related surface of the lower staircase; and the second enclosure board being connected across the second leg-related surface of the lower staircase.

14. The foldable staircase as claimed in claim 10 comprises:

a swingable support board;

a third enclosure board;

a counterfort;

the swingable support board comprises a free edge and a fixed edge;

the free edge and the fixed edge being positioned opposite to each other across the swingable support board;

the fixed edge of the swingable support board being hingedly connected to a perpendicular intersection of the first leg-related surface of the upper staircase and the second leg-related surface of the upper staircase;

the third enclosure board being connected across the second leg-related surface of the upper staircase;

the counterfort being connected in between the free edge and the lower staircase; and the hinged connection between the fixed edge of the swingable support board and the perpendicular intersection being a reverse hinge mechanism.

15. The foldable staircase as claimed in claim 10 comprises:

wherein the lower staircase and the upper staircase being in a collapsed configuration;

the series of steps for the lower staircase and the series of steps for the upper staircase being interlocked against each other; and the first step of the lower staircase being positioned adjacent to the last step of the upper staircase.

16. The foldable staircase as claimed in claim 10 comprises:

wherein the lower staircase and the upper staircase being in an operative configuration;

the series of steps for the lower staircase and the series of steps for the upper staircase being serially positioned to each other; and the first step of the lower staircase being positioned offset to the last step of the upper staircase.

17. The foldable staircase as claimed in claim 10 comprises:

a pulling tether; and the pulling tether being terminally connected to the lower staircase, adjacent to the series of steps of the lower staircase.

* * * * *